United States Patent [19]

Toyohara et al.

[11] Patent Number: 4,582,493

[45] Date of Patent: Apr. 15, 1986

[54] DRIVING DEVICE FOR AN OUTBOARD MOTOR

[75] Inventors: Makoto Toyohara, Shizuoka; Yukio Sumigawa, Iwata, both of Japan

[73] Assignee: Sanshin Kogyo Kabushiki Kaisha, Hamamatsu, Japan

[21] Appl. No.: 598,730

[22] Filed: Apr. 10, 1984

[30] Foreign Application Priority Data

Apr. 12, 1983 [JP] Japan ..... 58-62995

[51] Int. Cl.[4] ..... B63H 21/21

[52] U.S. Cl. ..... 440/84; 74/480 B; 440/86; 440/87

[58] Field of Search ..... 440/84, 86, 87, 85; 74/480 B

[56] References Cited

U.S. PATENT DOCUMENTS

| | | | |
|---|---|---|---|
| 2,082,058 | 6/1937 | Irgens | 440/86 |
| 2,682,248 | 6/1954 | Sitz | 440/86 |
| 3,524,423 | 8/1970 | Bitney | 440/86 |
| 3,820,641 | 6/1974 | Borst et al. | 74/480 B X |
| 3,922,996 | 12/1975 | Meyer | 440/87 |
| 4,253,349 | 3/1981 | Floeter et al. | 74/480 B X |

*Primary Examiner*—Sherman D. Basinger
*Attorney, Agent, or Firm*—Ernest A. Beutler

[57] ABSTRACT

Two embodiments of control device for outboard motors wherein the engine throttle control, transmission control and kill switch are all supported by the steering handle and are operative independently of each other. In one embodiment, the transmission control is pivotal about an axis offset to an axis of rotation of the throttle control. In the other embodiment, the transmission control is reciprocal along a line parallel to the axis of rotation of the throttle control.

17 Claims, 10 Drawing Figures

DRIVING DEVICE FOR AN OUTBOARD MOTOR

BACKGROUND OF THE INVENTION

This invention relates to a driving device for an outboard motor and more particularly to an improved and simplified control device for such a motor.

As is well known, outboard motors are conventionally steered by means of a steering handle that is affixed to the steering shaft of the outboard motor for steering it about its vertically extending steering axis. For convenience, it has been proposed to provide both throttle and transmission controls on the steering handle of the outboard motor so that the operator may control steering, engine speed and shifting with a single hand. Although such devices offer considerable advantage to the operator, it has been the practice to employ a single rotatable handle that controls both steering and shifting. Using such single handle controls introduces a fairly substantial amount of complication into the mechanism for operating both the transmission and throttle. In addition, the relatively compact nature of the steering mechanism makes it difficult to provide such controls within a single handle. In addition, such single handle controls are not always the most convenient to an operator.

Although it has been proposed to provide separate throttle and transmission controls, such separate controls have both been rotatable about the same axis and thus many of the problems attendant with the single handle control are attendant with these separate controls.

It is, therefore, a principal object of this invention to provide an improved and simplified control device for an outboard motor.

It is a further object of this invention to provide a convenient control device for an outboard motor and one which has relatively simple and uncomplicated construction.

It is a further object of this invention to provide a steering, throttle and transmission control for an outboard motor that are convenient for the operator to handle and yet which provide separate controls.

Although it has been the practice to provide the throttle and transmission controls on the steering handle of an outboard motor, it is still necessary for the operator to reach back to the motor to shut it off. That is, it has been the conventional practice to mount the kill switch for the outboard motor directly on the power head. This is now always convenient for the operator.

It is, therefore, a still further object of this invention to provide an improved control device for an outboard motor wherein all of the major controls are readily accessible to the operator.

It is a further object of this invention to provide a control device for an outboard motor wherein the steering, throttle control, transmission control and engine kill switch are all located at the end of the steering handle and in close proximity to the operator while still affording separate controls for each component.

SUMMARY OF THE INVENTION

A first feature of this invention is adapted to be embodied in a control device for an outboard motor or the like which outboard motor is supported for steering movement about a generally vertically extending axis and has a steering handle for steering the motor. Throttle means for controlling the speed of the motor and transmission means for controlling the direction of propulsion of the outboard motor are also provided. In accordance with this feature of the invention, throttle control means are journaled for rotation about an axis by the steering handle. Means operatively connect the throttle control means to the throttle means for operating the throttle means in response to rotation of the throttle control means. Transmission control means are also supported for movement by the steering handle in a direction other than about the axis of rotation of the throttle control means. Means operatively connect the transmission control means with the transmission means for control of the transmission means upon movement of the transmission control means.

Another feature of this invention is also adapted to be embodied in a control device for an outboard motor or the like that is supported for steering movement about a generally vertically extending axis and which has a steering handle for steering the motor. Throttle means control the speed of the motor and transmission means control the direction of propulsion of the outboard motor. In accordance with this feature of the invention, throttle control means, transmission control means and kill switch means are all independently mounted on the steering handle for controling the engine speed, transmission and running of the associated engine of the outboard motor.

DETAILED DESCRIPTION OF THE PREFERRED EMBODIMENTS

Embodiment Of FIGS. 1 Through 5

Figure 1:
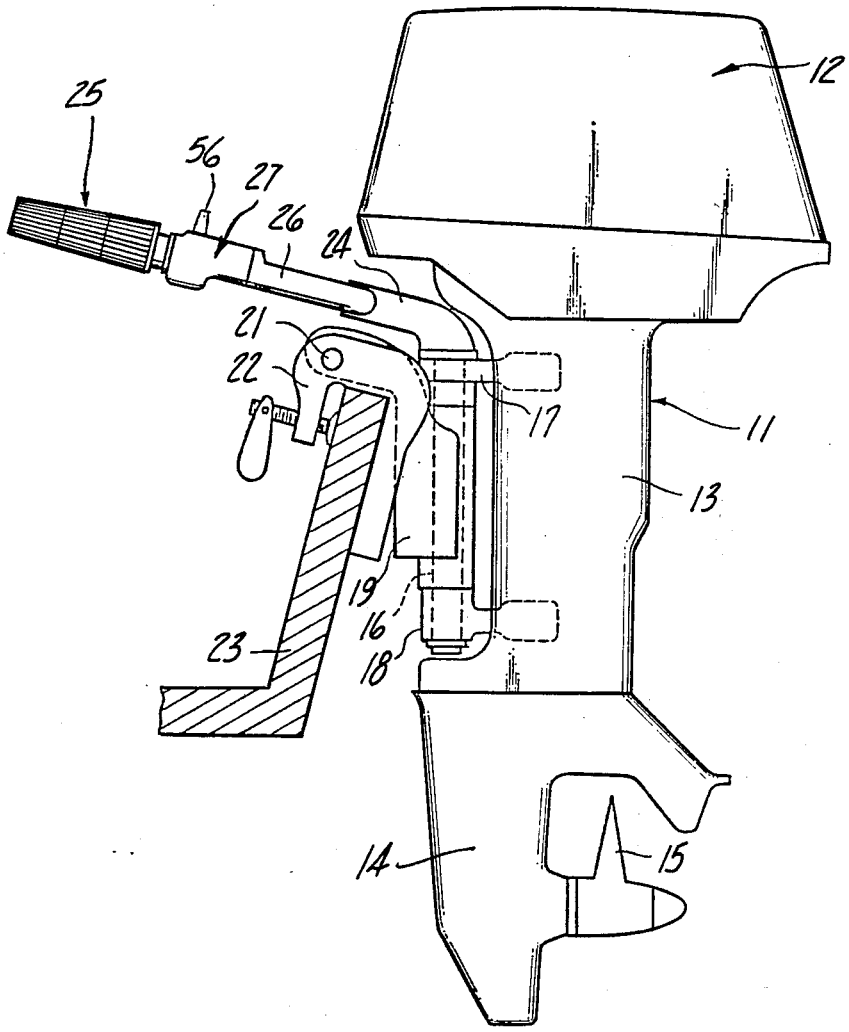
FIG. 1 is a side elevational view of an outboard motor constructed in accordance with a first embodiment of the invention and affixed to the transom of an associated watercraft.
Figure 2:
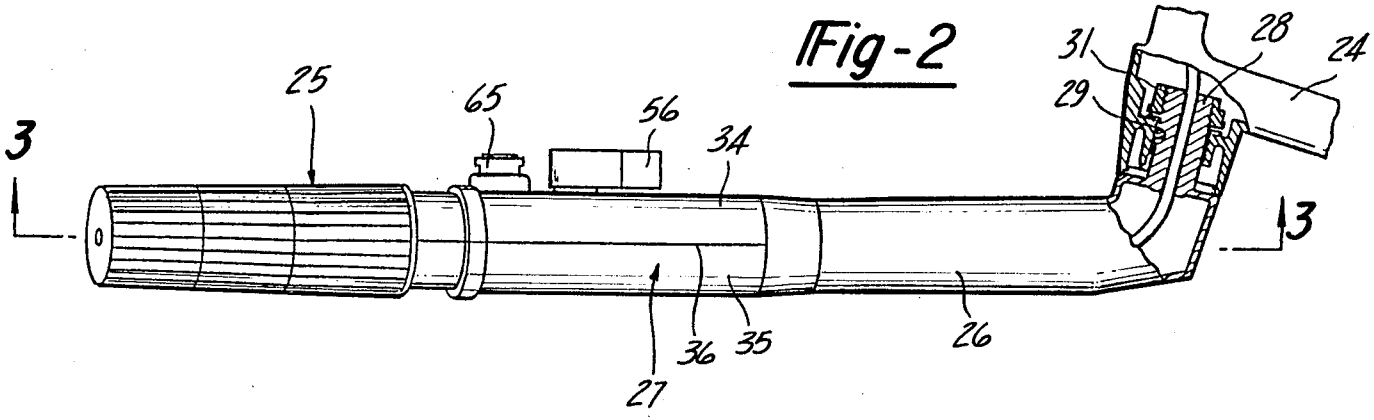
FIG. 2 is an enlarged, top plan view showing the control device constructed in accordance with the invention, with a portion broken away.
Figure 3:
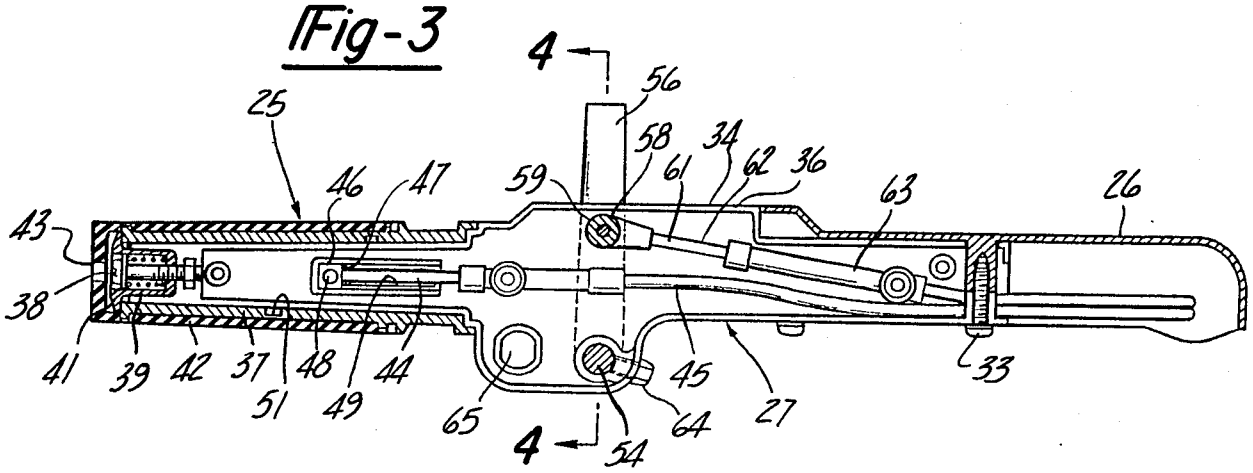
FIG. 3 is a cross-sectional view taken along the line 3—3 of FIG. 2.
Figure 5:
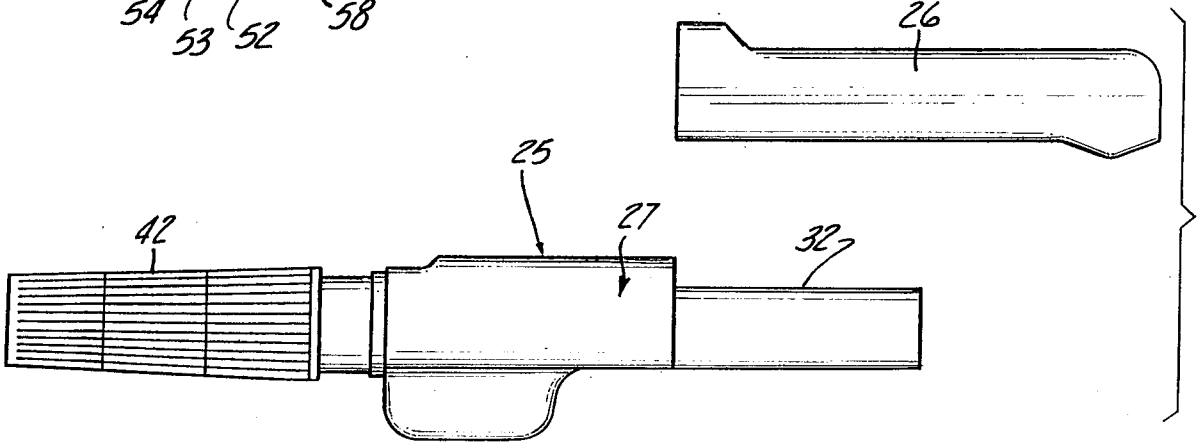
FIG. 5 is a disassembled view showing the handle separated from its base portion.
Figure 4:
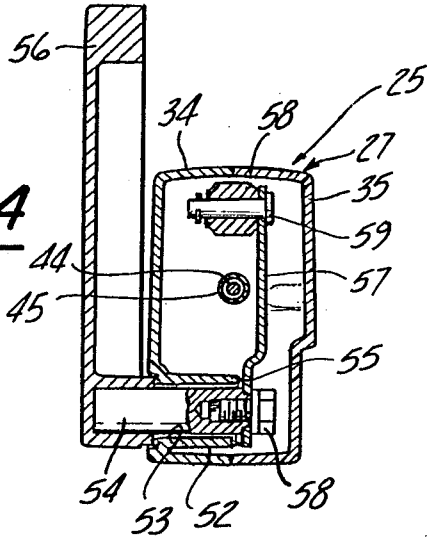
FIG. 4 is an enlarged, cross-sectional view taken along the line 4—4 of FIG. 3.

Referring first to FIG. 1, an outboard motor having a control device constructed in accordance with a first embodiment of the invention is identified generally by the reference numeral 11. The outboard motor 11 includes a power head, indicated generally at 12, which includes an internal combustion engine and surrounding protective cowling. The engine 12 drives a drive shaft (not shown) that extends through and is journaled in a drive shaft housing 13 in a known manner. Depending from the drive shaft housing 13 is a lower unit 14 in which a conventional forward, neutral, reverse transmission is contained for driving a propeller 15 in a known manner.

A steering shaft 16 is affixed to the drive shaft housing 13 by means of upper and lower supports 17, 18 which may include resilient damping means. The steering shaft 16 is, in turn, journaled in a swivel bracket 19 which is, in turn, supported for tilting movement about a horizontally extending axis by a pivot pin 21. The pivot pin 21 is journaled in a clamping bracket 22 which is provided for detachably affixing the outboard motor 11 to a transom 23 of an associated watercraft.

A steering bracket 24 is affixed to the upper end of the steering shaft 16 for rotating the steering shaft 16 and steering the motor 12 about the vertically extending steering axis defined by the swivel bracket 19. The construction thus far described may be considered to be conventional and for that reason none of the internal components of the outboard motor 12 have been illustrated.

In accordance with the invention, a combined steering handle and control unit, indicated generally by the reference numeral 25, and shown in most detail in FIGS. 2 through 5, is connected to the steering bracket 24 in a manner to be described.

The control unit 25 is divided into a base portion 26 and a control portion 27. The base portion 26 has a cylindrical part 28 that extends into a bore 29 of the bracket 24 and which is axially held in place by a nut 31 so as to rotatably connect the control device 25 to the steering bracket 24 for pivotal movement about an axis defined by the bore 29. The control unit 25 may be swung up to a storage position or moved down to the operative position as shown in the figures. When in the operative position, movement of the control unit 25 can effect steering movement of the steering bracket 24 and outboard motor 12 in a known manner.

The forwardly extending portion of the base 26 has a cylindrical or generally C shaped cross-section and is adapted to receive a cylindrical part 32 of the control portion 27. The portions 25 and 26 are affixed together by means of screws 33 that pass through apertures in the cylindrical portion 32 and are threaded into tapped holes formed in the base portion 26.

The control portion 27 consists of a main body formed from two parts 34 and 35 which are joined together and which define an internal cavity in which the control elements, to be described, are contained. The housing portions 34 and 35 have mating faces 36 so that the cavity defined by them will be sealed.

The body pieces 34 and 35 define a cylindrical bearing portion upon which a throttle control 37 is supported for rotation. The throttle control 37 is held in place by means of a screw 38 that is tapped into a nut held by the housing pieces 34 and 35. The screw 38 compresses a spring 39 against a thrust member 41 so as to hold the throttle control 37 in an axial position. The throttle control 37 is encased within a rubber grip 42 that is formed with an opening 43 so as to afford access to the head of the screw 38 and permit disassembly of the throttle control 37 from the remainder of the housing consisting of the body pieces 34 and 35.

The outboard motor 11 and specifically the internal combustion engine associated with the power head 12 has an appropriate speed control. If the engine is carbureted, the speed control will comprise the throttle valves of the carburetors. A bowden wire actuator consisting of a wire 44 and a protective sheath 45 is provided for operating the throttle valves or speed control of the engine. One end of the wire 44 is connected in an appropriate and known manner to the throttle mechanism of the engine. The wire 44 and protective sheath 45 extend through the steering bracket 24 through the hollow base portion 26 and into the cavity defined by the body pieces 34 and 35. The inner end of the wire 44 has a head piece 46 affixed to it. The head piece 46 is guided within a generally U shaped recess 47 formed by the body pieces 34 and 35. In addition, a cross pin 48 is affixed to the head piece 46 and extends through a slot 49 formed in one or both of the body pieces 34 and 35. The pin 48 is received in a helical groove 51 formed in an inner surface of the throttle control 37. Hence, rotation of the throttle control 37 effects reciprocation of the pin 48 and wire 44 so as to operate the speed control of the motor 11.

The body piece 34 is provided with a cylindrical boss 52 in which a bore 53 is formed. A shaft 54 is journaled within the bore 53 by means of an anti-friction bushing 55. The shaft extends outwardly from the housing member 34 and has a shift lever 56 affixed to its exposed end in a suitable manner.

A shift control lever 57 is affixed to the shaft 54 within the cavity defined by the housing members 34 and 35 by means of a screw 58 that is tapped into a threaded hole in the inner end of the shaft 54. The upper end of the shift control lever 57 is connected to a coupling member 58 by means of a pivot pin 59.

The coupling member 58 is affixed to one end of a wire 61 of a transmission control bowden wire actuator 62. The wire 61 is received within a protective sheath 63 and the bowden wire actuator 62 extends through the interior of the control device 25 including the base portion 26 and terminates at a control element that is operative to shift the transmission in the lower unit 14 between its forward, neutral, and reverse positions in response to axial movement of the wire 61 which is effected by pivotal movement of the shift lever 56 about the axis of the shaft 54. The shaft 54 may be lubricated by means of a grease fitting or nipple 64 formed in the housing member 34.

It should be readily apparent from the figures of the drawings that the shifting movement of the transmission by pivotal movement of the shaft lever 56 is accomplished without any interference between the bowden wire actuators of the transmission control and throttle control. The shift lever 56 extends at right angles to the axis of rotation of the throttle control 37 when the transmission is in its neutral position. Rocking the lever 56 in a forward direction can shift the transmission into forward and in a rearward direction will shift the transmission into reverse. Hence, a very compact assembly is provided and each of the transmission and throttle controls can be independent of the other and yet positioned in close proximity to the operator of the watercraft.

An engine kill switch 65 is also supported in the body member 34 between the transmission control lever 56 and the throttle control 37. As is well known, the kill switch 65 is wired into the ignition circuit of the engine contained within the power head 12 so as to ground the ignition and stop the engine in a known manner.

Figure 6:
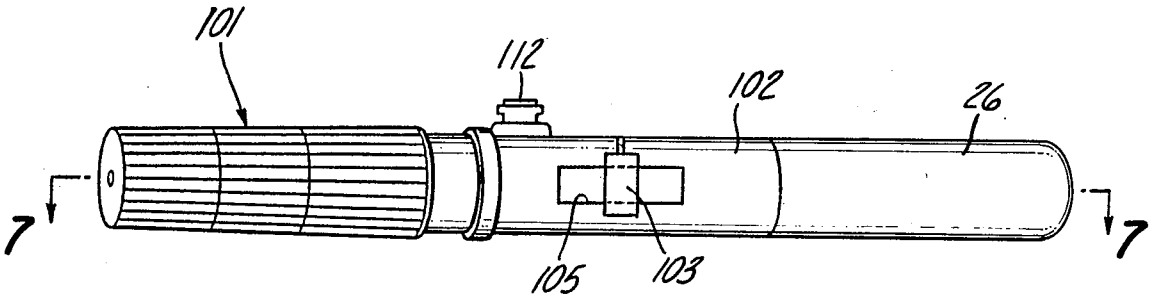
FIG. 6 is a top plan view of a control handle constructed in accordance with another embodiment of the invention.
Figure 7:
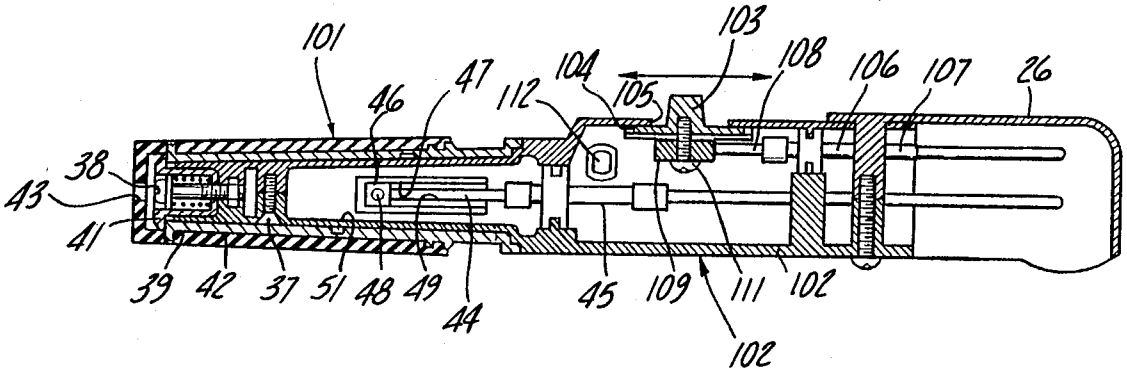
FIG. 7 is a cross-sectional view taken along the line 7—7 of FIG. 6.

Embodiment Of FIGS. 6 And 7

A control device constructed in accordance with a second embodiment of the invention is identified generally by the reference numeral 101. The control device 101 is adapted to be affixed to a steering bracket 24 of an associated outboard motor (not shown) as with the embodiment of FIGS. 1 through 5. Since this construction is the same as the previous embodiment, it has not been illustrated in detail and the control device base portion 26 has been identified by the same reference numeral inasmuch as this construction is the same as the previously described embodiment.

A control portion of the device 101 is comprises of an outer housing 102 made of two halves as with the previously described embodiment. These two halves define an internal cavity in which the mechanism, to be described, is contained.

A throttle control which is the same construction as the embodiment of FIGS. 1 through 5 is rotatably journaled by the housing 102 in the same manner as the previously described embodiment. For this reason, the components identifying the throttle control and its cooperation with the associated bowden wire have been identified by the same reference numerals and the construction and operation of these components will not be described again in detail.

In this embodiment, the transmission control is supported for reciprocation along a line parallel to the axis of rotation of the throttle control 37 rather than for pivotal movement about a transverse axis as in the embodiment of FIGS. 1 through 5. To this end, a transmission control member 103 is supported for sliding movement in a slot 104 formed in the housing 102 and has a portion projecting through an opening 105 formed in the housing 102 for access by the operator. A transmission control bowden wire assembly, indicated generally by the reference numeral 106, extends through the housing 102 and is connected to the transmission of the associated outboard motor in a known manner. The bowden wire 106 has a protective sheath 107 and a wire actuator 108, one end of which is connected to a coupling 109. The coupling 109 is, in turn, affixed to the control member 103 by means of a screw 111. Hence, reciprocation of the control member 103 will control the associated transmission. The control member 103 is centrally positioned in the slot 105 when the transmission is in the neutral position. Shifting of the member 103 forwardly will shift the transmission into forward. Shifting the control member 103 rearwardly from the neutral position will shift the associated transmission into reverse.

As with the previously described embodiment, an engine kill switch 112 is also mounted on the housing 102 between the transmission control member 103 and the throttle control 37. Hence, all of the associated components are positioned in close proximity to the operator and their internal components will not interfere with each other.

Figure 8:
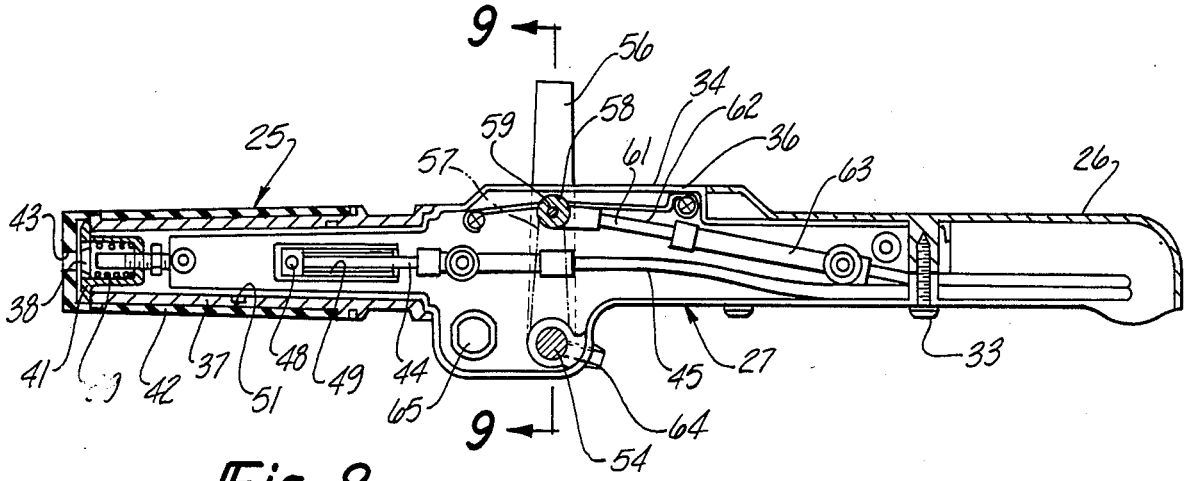
FIG. 8 is a cross-sectional view, in part similar to FIG. 3, showing yet another embodiment of the invention.
Figure 9:
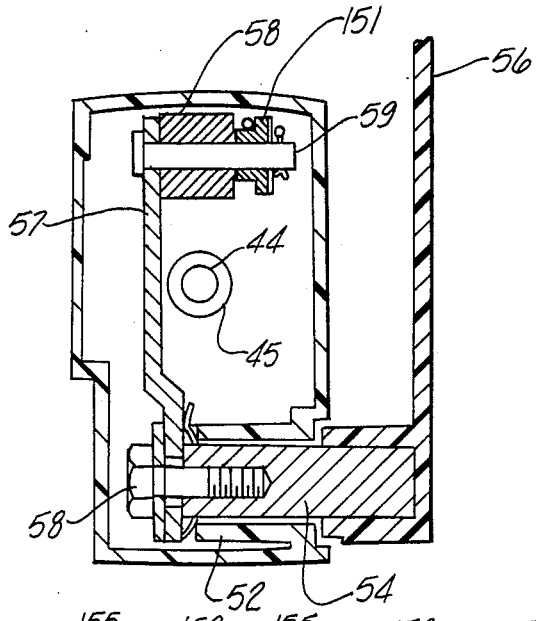
FIG. 9 is an enlarged, cross-sectional view taken along the line 9—9 of FIG. 8.
Figure 10:
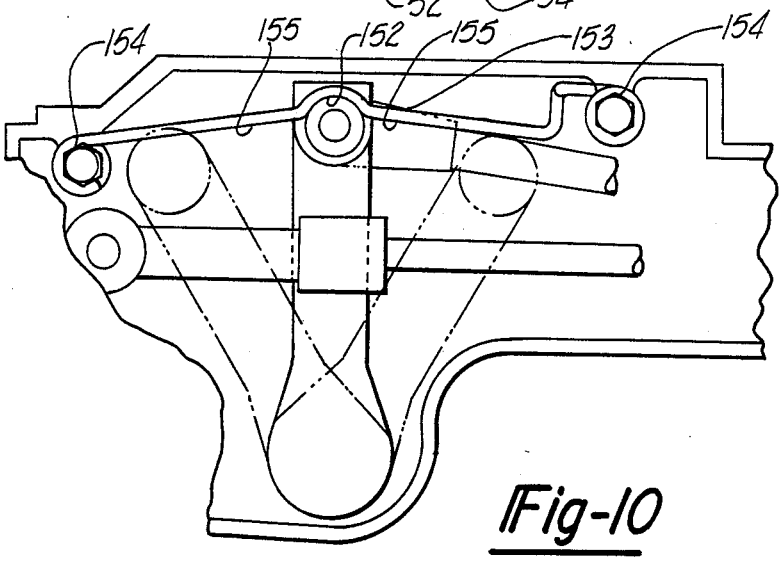
FIG. 10 is an enlarged view, in part similar to FIG. 8, showing the construction and operation of the detent mechanism.

Embodiment Of FIGS. 8 Through 10

FIGS. 8 through 10 show an embodiment of the invention that is similar to the embodiment of FIGS. 1 through 5. However, this embodiment further employs a detent mechanism for holding the transmission in its neutral position. Outside of that, the embodiment is the same as the embodiment of FIGS. 1 through 5 and, for that reason, the same components have been identified by the same reference numerals and will not be described again in detail.

In accordance with this embodiment, a collar 151 is affixed adjacent the connector 58 on the pin 59. The collar 151 is adapted to be engaged in a arcuate recess 152 of a wire spring assembly 153 that is supported by the housing 36 in a suitable manner, as by means of fasteners 154. The recess 152 is formed intermediate curved end portions 155 of the spring 153 and is adapted to engage the collar 151 when the shift lever 56 is in the neutral position as shown in FIG. 10 so as to hold the transmission in neutral. By applying sufficient force to the lever 56, however, the spring 153 will deflect and the transmission can be easily shifted into either forward or reverse in the manner aforedescribed.

It should be readily apparent that a similar detent mechanism may be used with the embodiment of FIGS. 6 and 7.

It should be readily apparent that the described embodiments permit independent control of the transmission, throttle and engine by independent actuators that are positioned in close proximity to the operator and which, with their associated controls, are clear of interference with each other. Furthermore, the formation of multiple actuating grooves in the throttle member as with the prior art constructions is avoided through this arrangement. Although two embodiments of the invention are illustrated and described, it should be readily apparent that various changes and modifications may be made without departing from the spirit and scope of the invention, as defined by the appended claims.

We claim:

1. In a control device for an outboard motor or the like supported for steering movement about a generally vertically extending axis having a steering handle for steering said motor, said steering handle extending forwardly from said motor, throttle means for controlling the speed of said outboard motor, and transmission means for controlling the direction of propulsion of said outboard motor, the improvement comprising throttle control means journaled for rotation about an axis by said steering handle and at the forward end thereof, means for operatively connecting said throttle control means to said throttle means for operating said throttle means in response to rotation of said throttle control means, transmission control means supported by said steering handle independently of said throttle control means and spaced rearwardly therefrom and for movement in a direction other than around said axis, and means for operatively connecting said transmission control means with said transmission means for controlling said transmission means upon movement of said transmission control means.

2. In a control device as set forth in claim 1 wherein the transmission control means is supported for pivotal movement about an axis other than said axis.

3. In a control device as set forth in claim 2 wherein the axis about which the transmission control pivots is perpendicular to the axis of rotation of the throttle control.

4. In a control device as set forth in claim 3 wherein the transmission control axis is offset from the axis of rotation of the throttle control.

5. In a control device as set forth in claim 4 wherein the steering handle comprises a first portion affixed to the motor and extending forwardly therefrom and a control portion pivotally connected to the forward end of said first portion for movement about a generally horizontally and transversely extending axis and carrying the transmission control means and the throttle control means at its forward end.

6. In a control device as set forth in claim 1 wherein the transmission control is reciprocally supported for movement in a direction parallel to the axis.

7. In a control device as set forth in claim 6 wherein the means for operatively connecting the throttle control means to the throttle means comprises a bowden wire actuator and the means for operatively connecting the transmission control means with the transmission means comprises a bowden wire actuator.

8. In a control device as set forth in claim 7 wherein the steering handle comprises a first portion affixed to the motor and extending forwardly therefrom and a control portion pivotally connected to the forward end of said first portion for movement about a generally horizontally and transversely extending axis and carrying the transmission control means and the throttle control means at its forward end, the bowden wire actuator extending through the pivotal connection of the control portion to the first steering handle portion.

9. In a control device as set forth in claim 1 wherein the means for operatively connecting the throttle control means to the throttle means comprises a bowden wire actuator and the means for operatively connecting the transmission control means with the transmission means comprises a bowden wire actuator.

10. In a control device as set forth in claim 9 wherein the transmission control means is supported for pivotal movement about an axis other than said axis.

11. In a control device as set forth in claim 10 wherein the axis about which the transmission control pivots is perpendicular to the axis of rotation of the throttle control.

12. In a control device as set forth in claim 11 wherein the transmission control axis is offset from the axis of rotation of the throttle control.

13. In a control device as set forth in claim 12 further including engine kill switch means carried by the steering handle in juxtaposition to the throttle control means and the transmission control means.

14. In a control device as set forth in claim 13 wherein the steering handle comprises a first portion affixed to the motor and extending forwardly therefrom and a control portion pivotally connected to the forward end of said first portion for movement about a generally horizontally and transversely extending axis and carrying the transmission control means and the throttle control means at its forward end, the bowden wire actuator extending through the pivotal connection of the control portion to the first steering handle portion.

15. In a control device as set forth in claim 9 wherein the steering handle comprises a first portion affixed to the motor and extending forwardly therefrom and a control portion pivotally connected to the forward end of said first portion for movement about a generally horizontally and transversely extending axis and carrying the transmission control means and the throttle control means at its forward end, the bowden wire actuator extending through the pivotal connection of the control portion to the first steering handle portion.

16. In a control device as set forth in claim 1 wherein the steering handle comprises a first portion affixed to the motor and extending forwardly therefrom and a control portion pivotally connected to the forward end of said first portion for movement about a generally horizontally and transversely extending axis and carrying the transmission control means and the throttle control means at its forward end.

17. In a control device as set forth in claim 1 further including engine kill switch means carried by the steering handle in juxtaposition to the throttle control means and the transmission control means.

* * * * *